US006182583B1

(12) United States Patent
Larson

(10) Patent No.: US 6,182,583 B1
(45) **Date of Patent: *Feb. 6, 2001**

(54) HEIGHT ADJUSTABLE PEDESTAL FOR CHAIRS AND TABLES

(76) Inventor: John E. Larson, P.O. Box 1197, Hamilton, MT (US) 59840-1197

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/173,236

(22) Filed: Oct. 15, 1998

Related U.S. Application Data

(63) Continuation-in-part of application No. 08/925,088, filed on Sep. 8, 1997, now abandoned

(60) Provisional application No. 60/090,116, filed on Jun. 22, 1998.

(51) Int. Cl.[7] ..... A87B 9/00

(52) U.S. Cl. ..... 108/147; 108/150; 297/344.19; 297/344.22; 248/404; 248/61

(58) Field of Search ..... 297/344.19, 344.21, 297/344.22, 344.18; 248/404, 422, 161; 108/147, 150

(56) References Cited

U.S. PATENT DOCUMENTS

| | | | | |
|---|---|---|---|---|
| 1,590,296 | | 6/1926 | Klein . | |
| 1,999,848 | * | 4/1935 | Ries | 297/344.19 |
| 2,216,348 | * | 10/1940 | Hunsicker | 248/404 |
| 2,923,344 | * | 2/1960 | La Voie et al. | 248/404 |
| 3,570,800 | | 3/1971 | Cycowicz . | |
| 3,787,039 | * | 1/1974 | Zeichman | 108/150 |
| 4,756,496 | | 7/1988 | Hosan et al. | 248/161 |
| 4,934,723 | * | 6/1990 | Dysarz | 297/344.19 |
| 5,078,351 | | 1/1992 | Gualtieri | 248/161 |
| 5,433,409 | | 7/1995 | Knopp | 248/161 |
| 5,437,236 | * | 8/1995 | Zeiner | 248/404 |
| 5,553,550 | * | 9/1996 | Doyle | 108/147 |
| 5,853,221 | * | 12/1998 | Thoman et al. | 297/344.22 |

FOREIGN PATENT DOCUMENTS

| | | |
|---|---|---|
| 18 01 159 | 4/1970 | (DE) . |
| 40 40 268 | 6/1992 | (DE) . |
| 2342686 | 9/1977 | (FR) . |
| 2691889 | 12/1993 | (FR) . |
| 8800880 | 11/1989 | (NL) . |

OTHER PUBLICATIONS

Versteel Adjustable Height Table Product Information Copyright 1994.

International Search Report, Jan. 26, 2000 van Bilderbeck, H.

* cited by examiner

*Primary Examiner*—Anthony D. Barfield
(74) *Attorney, Agent, or Firm*—Jerry Johnson

(57) ABSTRACT

A height adjustable pedestal comprises a base, a height adjustment column disposed above the base and supported thereon, and a table top or chair seat support disposed above the height adjustment column. The height adjustment column comprises at least two spring actuated telescoping height adjustment mechanisms. The height adjustment column typically additionally includes at least one stand tube each having a first and a second end. The first end includes an opening or hole through which a telescoping height adjustment mechanism passes. The second end of each stand tube is proximate to the base. At least one support, disposed vertically above or below the base of the pedestal, for securing the stand tubes together, may also be included. Telescoping height adjustment mechanisms used in the pedestal are typically gas springs. Supports for securing the stand tubes together may comprise a platform. Such platforms include attachment means to attach the platform to the base. Each of the stand tubes in this version extend vertically from the platform and is supported therefrom. Supports for securing the stand tubes together may also comprise at least one attachment bracket. Such attachment brackets are vertically separated from the base.

47 Claims, 12 Drawing Sheets

HEIGHT ADJUSTABLE PEDESTAL FOR CHAIRS AND TABLES

The present application is a continuation-in-part of U.S. patent application Ser. No. 08/925,088 filed Sep. 08, 1997 now abandoned, entitled "Height Adjustable Work Chair Having a Non-Swivel Seat" by the same inventor as the present application. That application is incorporated herein by this reference. The present application also claims the benefit under 35 U.S.C. 119E of U.S. Provisional Patent Application Ser. No. 60/090,116 filed Jun. 22, 1998 entitled "Height Adjustable Pedestal for Chairs and Tables" by the same inventor as the present application.

BACKGROUND

Height adjustable work chairs are used in home, office, education, and industry. These height adjustable chairs typically include a seat that swivels in relation to the base of the chair. The height adjustment is typically obtained from a telescoping height adjustment mechanism which is usually a gas spring. This gas spring is a telescoping column that includes a gas cylinder which includes a pressurized gas such as nitrogen; a piston extending downwardly from the cylinder which supports the cylinder in an elevated position and includes an end which secures the gas spring to the chair base; and a valve located within the cylinder which allows the movement of gas within the cylinder.

The top of the cylinder is secured within the seat support mechanism which is the mechanism that supports the chair seat and chair back. The seat support mechanism is also known as the chair tilt mechanism, particularly on chairs with adjustable backrests or chairs having a tilting chair seat. Also included in the seat support mechanism is a lever that actuates the valve located in the gas spring. The valve typically includes a pin extending from the top of the cylinder which when depressed by the lever allows gas to move through the valve and lower the cylinder if a force exceeding gas pressure is applied on the spring or raise the cylinder if no force is applied on the spring. The gas spring may additionally include an air or oil damping mechanism which slows the rate of compression and extension for the gas spring.

The gas spring which is responsible for height adjustment in work chairs also allows the seat to swivel in relation to the base. The gas spring cylinder which is secured to the chair seat through the seat support mechanism rotates freely in relation to the piston which supports it. It is this rotation which provides the swivel in most work chairs. Additionally the end of the piston which is attached to the chair base may also include ball bearings or other means to allow the piston to rotate in relation to the base while remaining secured to the base. In this way, the gas spring which is a very inexpensive mechanism to manufacture provides both height adjustment and swivel movement of the chair seat in relation to the base.

The gas spring is supported in a vertical position between the chair base and the chair tilt mechanism by a vertical stand tube. The stand tube includes a top opening sized so that the cylinder of the gas spring can move vertically and rotationally in relation to the stand tube, yet remain supported by the stand tube regardless of the vertical or rotational position of the cylinder.

The stand tube is typically a metal cylinder which includes top and bottom ends. An opening on the top end which is sized to accommodate a gas spring cylinder which moves vertically in relation to the stand tube. In some instances a bushing may be disposed within the opening to minimize friction between the gas spring cylinder and the stand tube. The opening serves to both guide the gas spring cylinder as well as to vertically support the gas spring which extends between the chair seat support mechanism and the chair base.

The bottom end of the stand tube cylinder typically is tapered for insertion into the chair base. The tapered bottom end is typically pressed into a tapered socket at the hub or center of the chair base. The stand tube bottom may include an opening through which the piston of the gas spring can extend so as to be secured to the chair base. Alternatively, the stand tube bottom end can include an appropriate structure for securing the gas spring piston. This structure also may include an opening in the stand tube bottom end.

An alternative to the gas spring is a metal coil type spring which includes an oil damping mechanism. The application of a spring of this type is shown in U.S. Pat. No. 5,078,351. An alternative to the typical stand tube arrangement is shown in U.S. Pat. No. 5,433,409. The inventors of both of these alternative chair components believe that their components address structural deficiencies found in existing chair component assemblies.

These structural deficiencies are most often derived from the use of a gas spring as both the structural support for the chair as well as the mechanism which provides vertical adjustability to the chair. The dual purpose of the gas spring, as well as the manner that the gas spring is supported, and the manner that the gas spring is attached to the chair seat support mechanism and the chair base, may cause the gas spring or the supporting structure for the gas spring to fail.

Gas spring mechanisms are remarkably strong despite the light gauge metal used in their construction. The cylinder portion of the gas spring, which is typically constructed of light gauge metal, is a sealed assembly which includes an internally held compressed gas. The cylinder also comprises the structure which provides the attachment between the height adjustable chair pedestal and the chair seat. Typically, the cylinder of the gas spring is attached to the seat support or chair tilt mechanism within a tapered socket or a hole within the seat support or chair tilt mechanism. Accordingly, all of the weight on the chair seat must be transferred through the light gauge cylinder wall. The forces exerted on the cylinder may include high bending moments, if the weight of the chair user is not sitting on center of the chair seat, in addition to the compressive forces acting downward on the cylinder of the gas spring due to the users weight.

These compressive and bending forces may result in considerable stresses exerted on the light gauge cylinder walls which can result in a catastrophic failure of the cylinder. Additionally, the concentration of stresses in each of the chair components results in shape distortions to occur in these components. These distortions result in play or looseness developing, particularly at the high stress attachment points of the components. Play is known to develop particularly early at the attachment location of the cylinder to the seat support or tilt mechanism. This play, once created, can further accentuate stress concentrations at specific locations on the cylinder wall which also can lead to a catastrophic failure of the cylinder wall.

Similar forces exist between the gas spring cylinder and the stand tube. As has been previously described, the stand tube supports the gas spring by providing a top opening through which the cylinder of the gas spring passes. The gas spring cylinder moves vertically, as well as rotationally in relation to this opening. The stand tube may include a bushing to reduce friction between the cylinder and the stand tube.

Forces exerted on the gas spring cylinder may be transferred to the stand tube at the opening location. As the opening must be made larger than the cylinder to permit both vertical and rotational movement of the cylinder, these forces may be transferred from a small segment of the thin wall of the cylinder to the stand tube along the short support surface provided by the opening. This concentration of forces can cause failure of the cylinder either by shearing the cylinder wall or by causing a small dent in the cylinder wall which could lead to the cylinder buckling at a later time. Forces that are not transferred to the stand tube are transferred first to the piston of the gas spring cylinder and then to the chair base. The forces on the piston can also cause the small diameter rod of the piston to buckle.

Other stand tubes include a honeycomb structure within the interior of the stand tube cylinder to prevent a concentration of forces on the gas spring cylinder at an opening. In this design, forces on the gas spring that are transferred to the stand tube are transferred over a large surface of the honeycomb structure within the stand tube interior. The honeycomb structure flexes in response to such forces assuring a large contact surface for force transfer and minimizing shear forces on the gas spring. The excessive flexure within this design results in a chair having a non-rigid pedestal having a great deal of play. Accordingly, chairs having this construction do not appear sturdy and durable to consumers. Additionally, the flexing of the gas spring allowed by the flexible honeycomb structure may also cause the gas spring to eventually fail. It is also likely that this excessive flexing of gas springs may contribute to gas leakage from the gas spring.

Additionally, the forces resulting from pressurized gas within the cylinder are increased by forces on the chair seat which also are transferred through the gas spring. Gas losses through the cylinder seals are affected by the forces exerted on the gas spring. Should forces be applied to the gas spring which are either too high for the gas spring or are applied at an excessive rate, the gas spring seals can also fail, resulting in the immediate loss of gas pressure and a sudden complete compression of the gas spring. Such a failure could also result from normal use of the chair over a long period of time. Gas losses resulting from a progressive loss of the high pressure gas are evident in all gas springs and are most pronounced in those having the highest initial gas pressures.

Other areas where failures can occur are at the chair base hub socket where the stand tube is attached to the chair base. This area is particularly prone to failure in chairs having a one piece molded base that includes a center hub having a tapered socket for receiving the tapered bottom end of the stand tube, and a plurality (typically 5) of spokes which radiate from the hub. The molded plastic hub socket wall supports the rigid metal stand tube in a vertical position. Forces transmitted through the stand tube are transferred to the hub at this location. The high strength, and highly rigid steel stand tube may first become loosely held within the plastic chair base hub socket due to normal use of the chair. The socket wall also may be prone to breakage due to material fatigue stresses, or as a result of the uneven application of forces on the socket, which result from play within this joint. All metal chair bases are also prone to developing play in this joint, but are understandably less likely to fail.

All of the described modes for height adjustable chair pedestals may result in injuries to the chair user as well as property damage. Obviously, a catastrophic failure of a chair may cause the person on the chair to fall from the chair without any warning.

All of the previously mentioned problems with height adjustable pedestals used in office type chairs have prevented the widespread use of similar height adjustable pedestals in tables. Off center forces exerted on a table top close to the perimeter of the table top are a considerable distance from the center pedestal supporting the table top. Such forces obviously result in high bending moments on a small diameter gas spring cylinder which is incorporated into the pedestal for supporting a vertically adjustable table top.

Due to the current limitations of gas spring height adjustment in table constructions, height adjustable table manufacturers have typically used either hydraulics or electric motors to provide vertical adjustability. Such mechanisms, which have been in use for decades, are typically very durable and do not have failure modes consistent with gas spring height adjustment. These mechanisms, however, are not in widespread use because of their considerable expense. Tables that incorporate these devices are, or course, very expensive which limits the use of height adjustable tables in residential, office, educational, and industrial environments.

For the foregoing reasons, there is a need for a height adjustable pedestal for use with chairs and tables commonly used in homes, offices, schools, and industry which provide the benefits of height adjustment at an economical price and are not subject to dangerous catastrophic failures.

In particular, there is a need for a height adjustable pedestal that allows forces to be transferred from the chair seat or table top to the floor which will not cause excessive concentrations or stresses within the elements of the height adjustable pedestal which can lead to catastrophic failure of these elements.

There is a need for a height adjustable pedestal for chairs and tables that are able to be assembled from currently available low cost components, such as gas springs, yet overcome the deficiencies of these components. There is a further need that existing low cost assembly practices can be used in the chairs and tables using these height adjustable pedestals.

There is also a need for a height adjustable pedestal that is constructed to minimize wear in the components of the pedestal assembly. By minimizing wear, such chairs and tables would not develop excessive play within the structural joints connecting components of the pedestal assembly.

There is a need for a height adjustable pedestal that is low cost, low in weight, high in strength and durability, and high in aesthetics which will provide greater widespread use of height adjustment in both tables and chairs.

SUMMARY

The height adjustable pedestal of the present invention satisfies the previous mentioned needs for a height adjustable pedestal for chairs and tables that utilizes inexpensive gas springs for height adjustment which is high in strength and durability.

The height adjustable pedestal of the present invention comprises a base, and a height adjustment column disposed above the base and supported thereon. The height adjustment column comprises at least two spring actuated telescoping height adjustment mechanisms. The height adjustable pedestal further includes means to actuate the telescoping height adjustment mechanisms. The height adjustment column typically additionally includes at least two stand tubes each having a first and a second end. The first end includes an opening or hole through which a telescoping height adjustment mechanism passes. The second end of each stand tube is disposed proximate to the base. At least one support disposed vertically above or below the base of the pedestal for securing the stand tubes together may also be included.

Telescoping height adjustment mechanisms used in the pedestal are typically gas springs. Such gas springs comprise: a cylinder, a piston disposed within the cylinder and extending downwardly therefrom to a secured position on the chair base from where it supports the gas spring, a gas flow control valve disposed within the cylinder; and pressurized gas disposed within the cylinder.

Supports for securing the stand tubes together may comprise a platform. Such platforms may include attachment means to attach the platform to the base. Each of the stand tubes in this version extend vertically from the platform and is supported therefrom. Supports for securing the stand tubes together may also comprise at least one attachment bracket. Such attachment brackets are typically vertically separated from the base.

Typically at least one telescoping height adjustment mechanism comprises a lockable gas spring which includes a gas flow control valve extension that extends from the gas flow control valve within the gas spring cylinder. The means to actuate the height adjustment mechanisms actuates the valve of each lockable gas spring mechanisms by engaging the gas flow control valve extension of each respective lockable gas spring mechanism.

The means to actuate the height adjustment mechanisms typically comprises a lever that toggles between a first position wherein the gas flow control valve of each lockable telescoping height adjustment mechanism is not actuated and a second position wherein the gas flow control valve of each lockable telescoping height adjustment mechanism is actuated. The lever in the second position actuates the gas flow control valve to allow gas to move through the gas flow control valve which selectively lowers the cylinder if a force exceeding the gas pressure is applied on the gas spring or raises the cylinder if a force less than the gas pressure is applied on the gas spring.

The height adjustable pedestal of the present invention may additionally comprise a seat support mechanism, or a table top support mechanism. These mechanisms typically include receiving means for receiving each telescoping height adjustment mechanism. Additionally, the mechanisms typically support the means to actuate the telescoping height adjustment mechanisms. The table top or chair seat support mechanism may additionally include a controlled swivel mechanism.

The height adjustable pedestal of the present invention provides benefits which are currently unavailable to users of height adjustable chairs and tables.

The invention utilizes many existing low cost chair components which have been assembled by known low cost assembly techniques, into a new height adjustable pedestal which provides safety related benefits not currently available. The structural features of the height adjustable pedestal which provide these safety related benefits ensure that individual components of the chair or table pedestal will not fail catastrophically which can result in both injury to the user as well as to property damage.

Additionally, the structural features of the height adjustable pedestal which provide these safety related benefits also provide benefits that enhance the overall quality of construction of chairs and tables. Accordingly, chairs and tables incorporating the height adjustable pedestal of the present invention into their design are of a sturdy, high quality construction, that is typically only available at prohibitively high costs in the marketplace.

The height adjustable pedestal of the present invention uses at least two spring actuated telescoping height adjustment mechanisms, which are typically gas springs. Each gas spring is typically supported within a single stand tube or multiple gas springs may be supported in a single stand tube. The plural gas spring construction results in the even distribution of loads throughout the individual gas springs. This distribution of forces results in a decrease in the concentration of stresses within the gas springs, particularly at the points where the cylinders of the gas springs attach to a seat or table top support mechanism. Additionally, the concentration of stresses where the gas spring cylinders contact the stand tubes are minimized in the height adjustable pedestal of the present invention. As earlier described, stress concentrations within the thin wall of the gas spring cylinder are common at these areas in existing height adjustable pedestals.

The distribution of loads throughout two or more gas springs in the present invention ensures that bending moments due to loads applied away from the chair seat or table top center will be lower. The resultant stress concentrations due to these bending moments are, of course, also correspondingly decreased. Furthermore, the use of two or more gas spring assemblies ensures that each of the individual gas springs will be securely held in the vertical position so that stress concentrations due to distortion are also minimized. Reducing stress concentrations also decreases the likelihood of gas spring seal failure. The distribution of loads throughout two or more gas springs in the present invention also ensures that looseness or play will not develop at the joints within the pedestal where gas springs are attached to the chair seat support or table top support.

Stress concentrations that may cause the gas spring piston or the chair base to fail are also unlikely in the pedestal of the present invention. These are both highly stressed areas in current chair designs. The present invention is constructed so that high stresses will not concentrate in these areas, as forces will be evenly distributed throughout more than one telescoping gas spring and if necessary more than one chair base socket. In the single socket base versions of the present invention, forces will be transferred vertically through the pedestal. This ensures that uneven loads which could result in failure of the chair base socket are diminished.

Here again, looseness or play is much less likely to develop between the stand tubes and chair base socket as uneven loading on this area is less likely. Play in this area, as well as at the attachment point of the gas spring cylinders to the seat support or table top mechanisms, causes chairs and tables to be much less stable. This play is significant in many current chair and table assemblies. Chairs and tables constructed with the height adjustable pedestal of the present invention will be easily identified as having a sturdier, higher quality construction due to this absence of play.

Additionally, as the pedestal incorporates the use of more than one gas spring, each gas spring will have a corresponding decrease in internal gas pressure. The lower initial gas pressure of each gas spring results in lower gas pressure losses in each gas spring. These progressive gas pressure losses are evident in all gas springs but are significantly higher in high pressure gas springs.

In short, the height adjustable pedestal of the present invention provides a low cost means to ensure that safe, sturdy chairs and tables can be used in homes, offices, schools and industry.

These and other advantages of the present invention will become apparent upon inspection of the accompanying specification, claims, and drawings.

DRAWINGS

FIG. 1(*a*) is an exploded view of an alternative height adjustment actuation mechanism for the table of FIG. 1.

Figure 2:
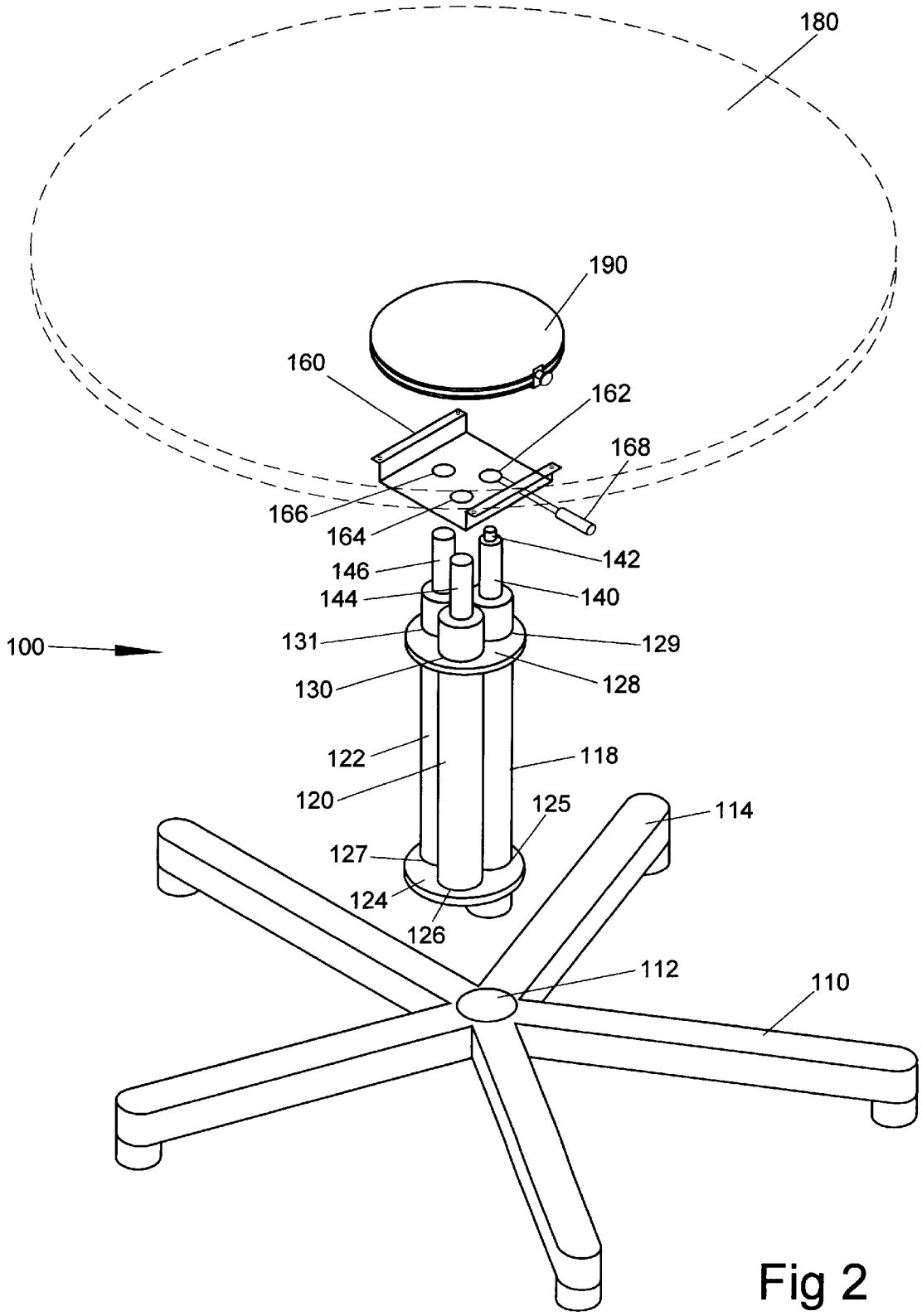
FIG. 2 is an exploded view of a table using a second version of the height adjustable pedestal of the present invention.
Figure 2A:
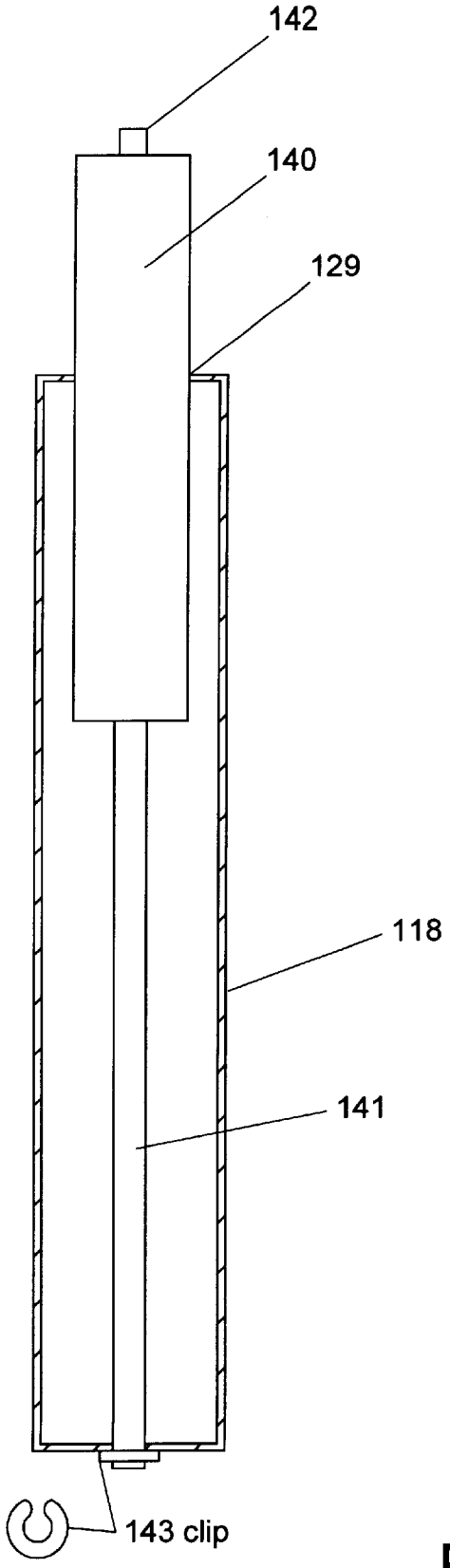

FIG. 2*a* is a cross sectional side view of a height adjustment column comprising a single stand tube and a spring actuated telescoping height adjustment mechanism.

Figure 3:
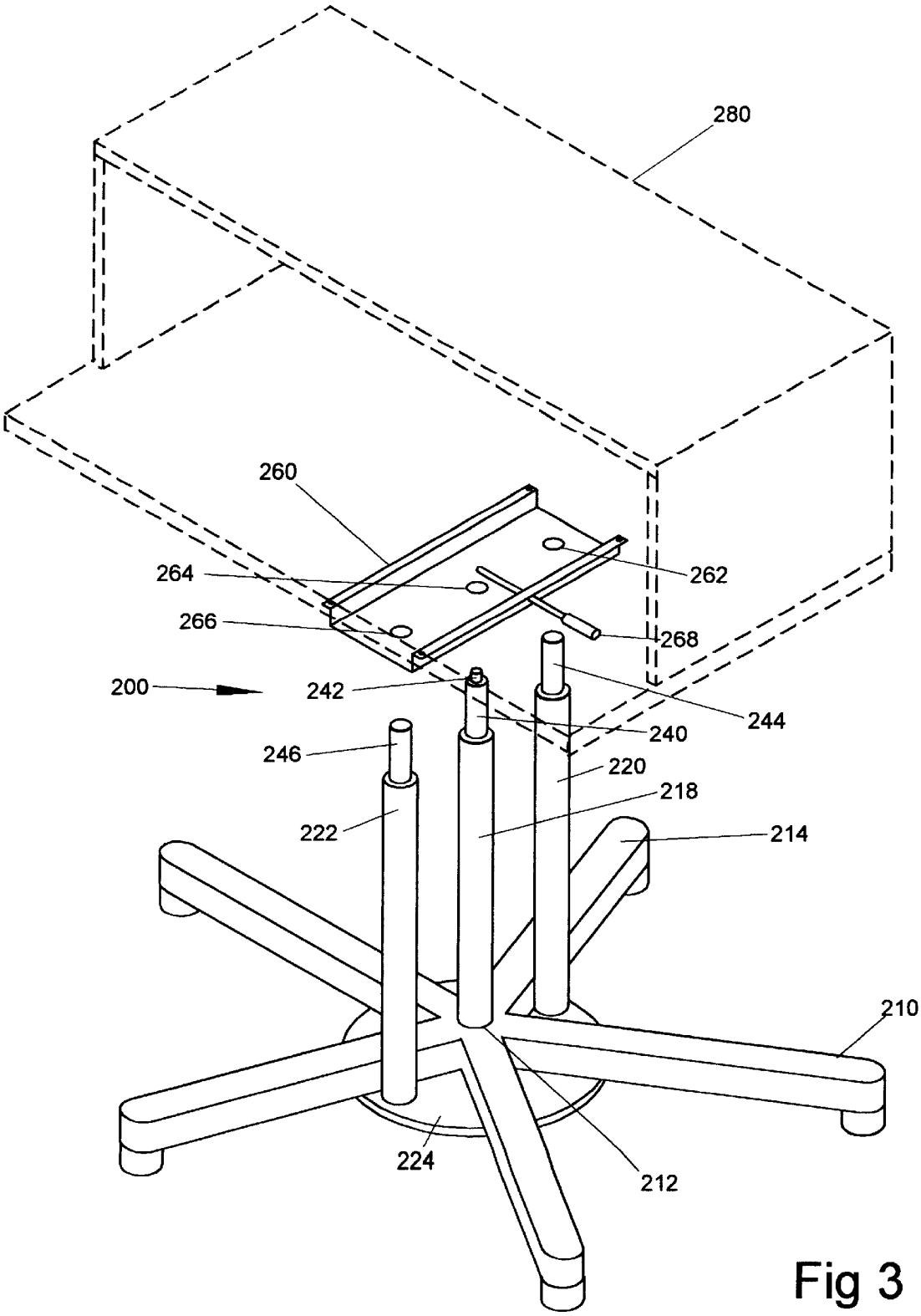

FIG. 3 is an exploded view of a work station table using a third version of the height adjustable pedestal of the present invention.

Figure 4A:
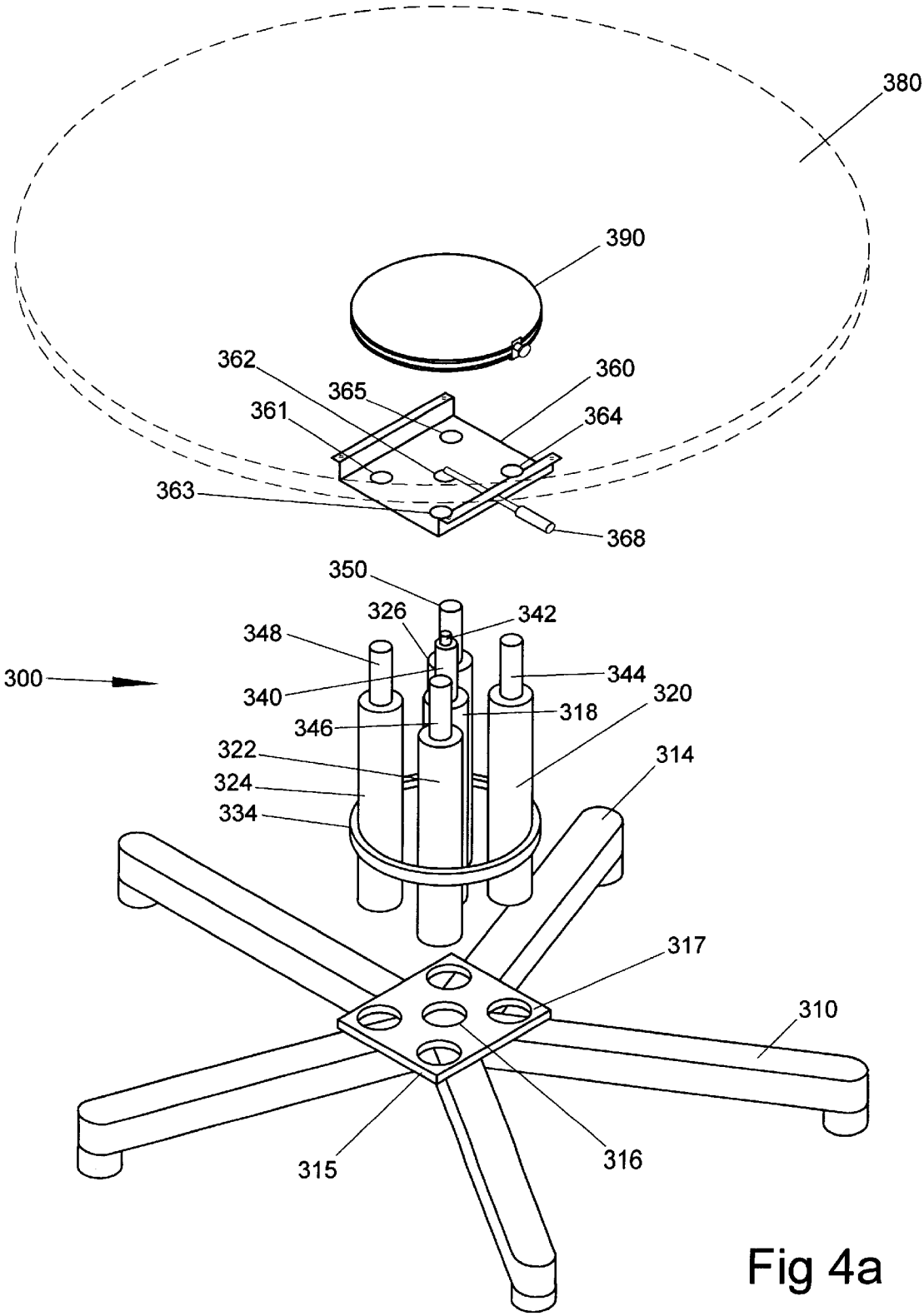

FIG. 4*a* is an exploded view of a table using a fourth version of the height adjustable pedestal of the present invention.

Figure 4B:
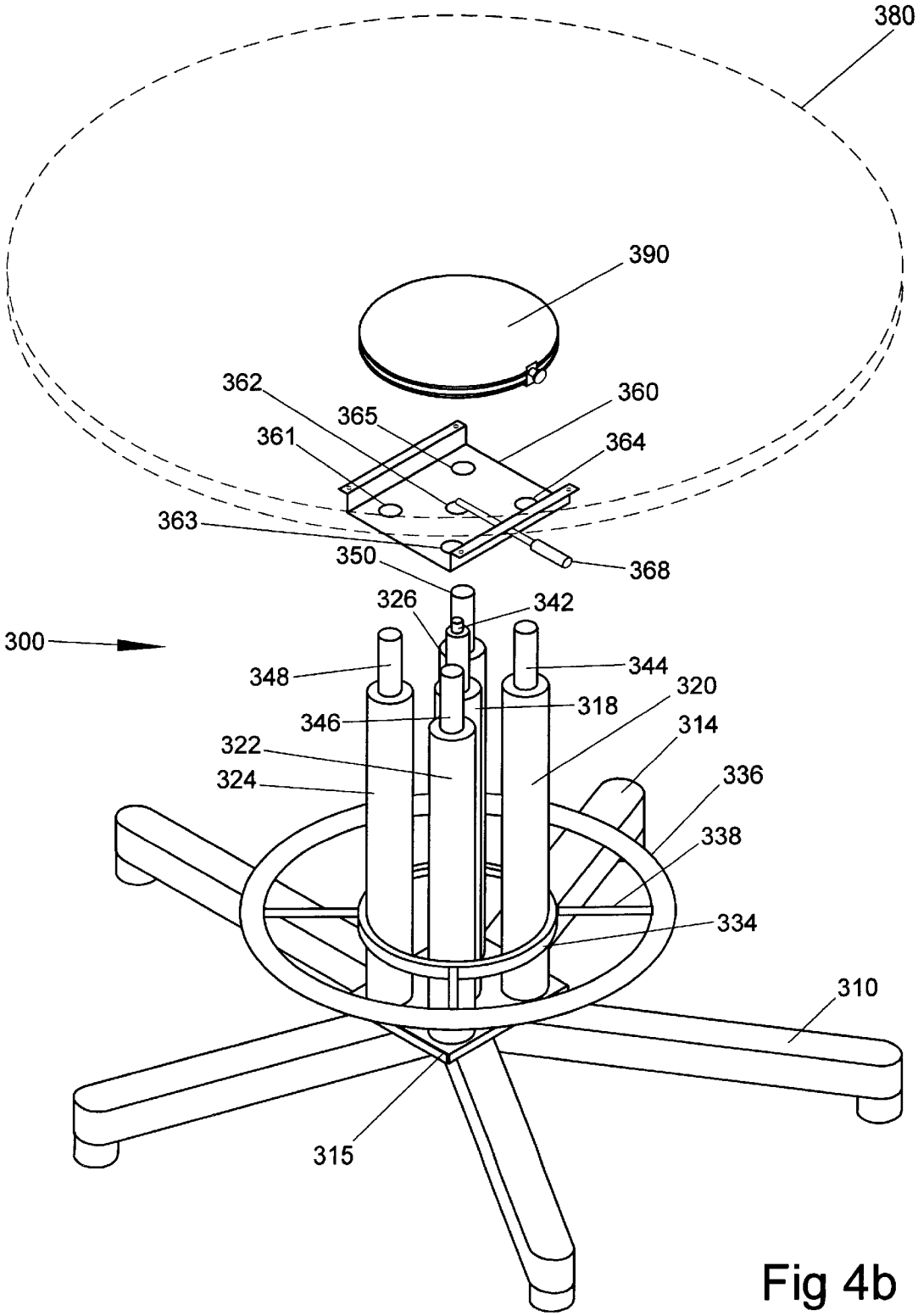

FIG. 4*b* is a partially exploded view of a table using a modified fourth version of the height adjustable pedestal of the present invention.

Figure 5:
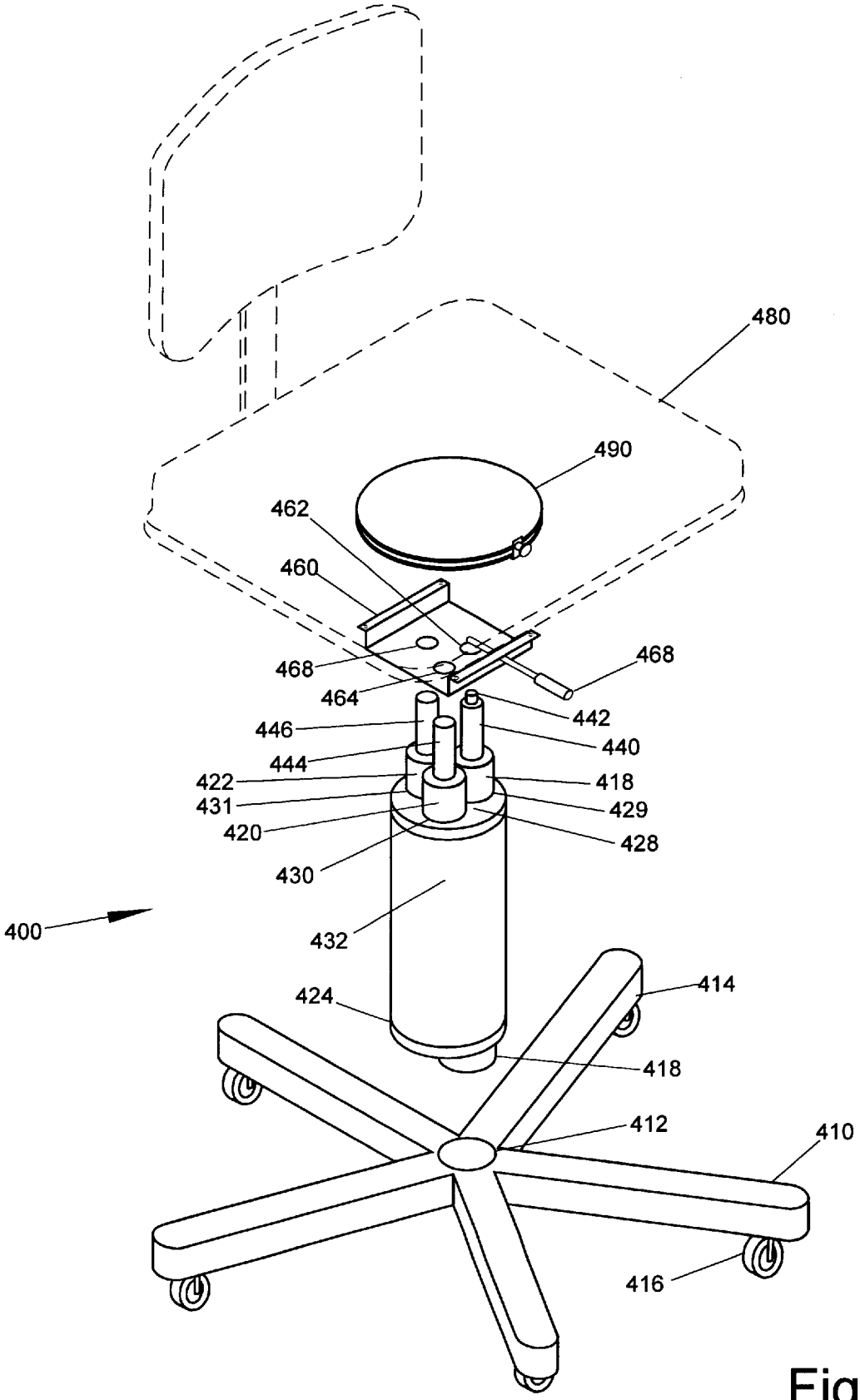

FIG. 5 is an exploded view of a chair using a fifth version of the height adjustable pedestal of the present invention.

Figure 6:
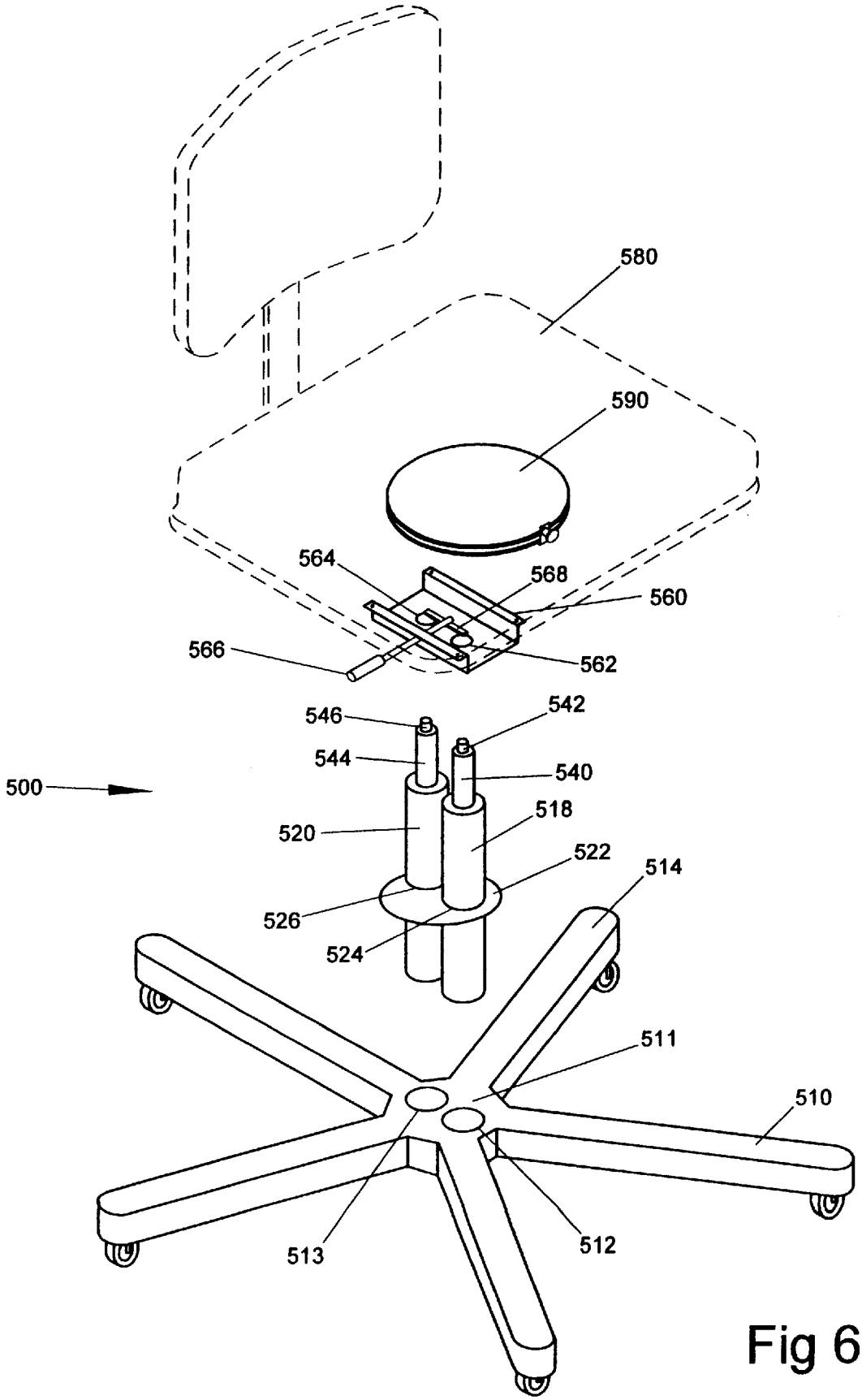

FIG. 6 is an exploded view of a chair using a sixth version of the height adjustable pedestal of the present invention.

Figure 7:
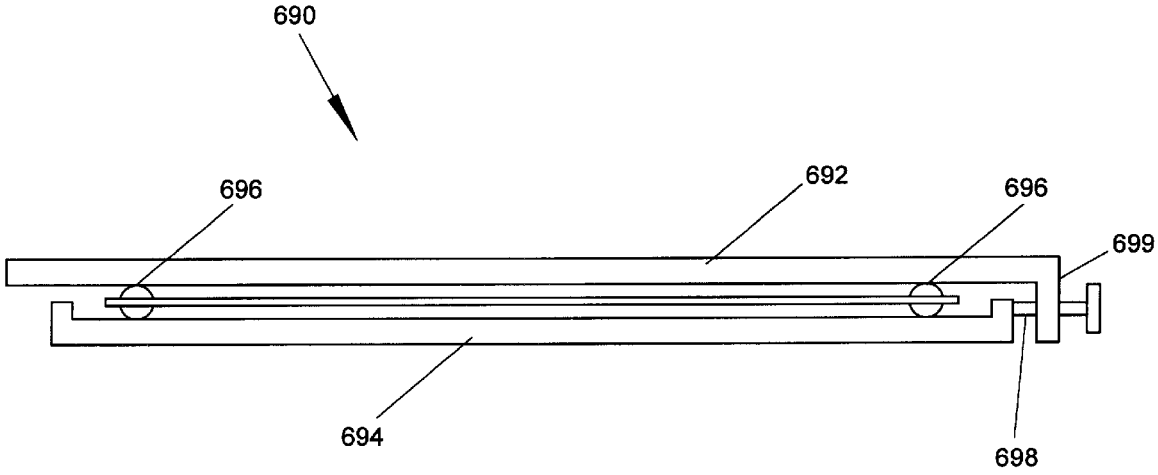

FIG. 7 is a view of the controlled swivel mechanism of the present invention.

Figure 8:
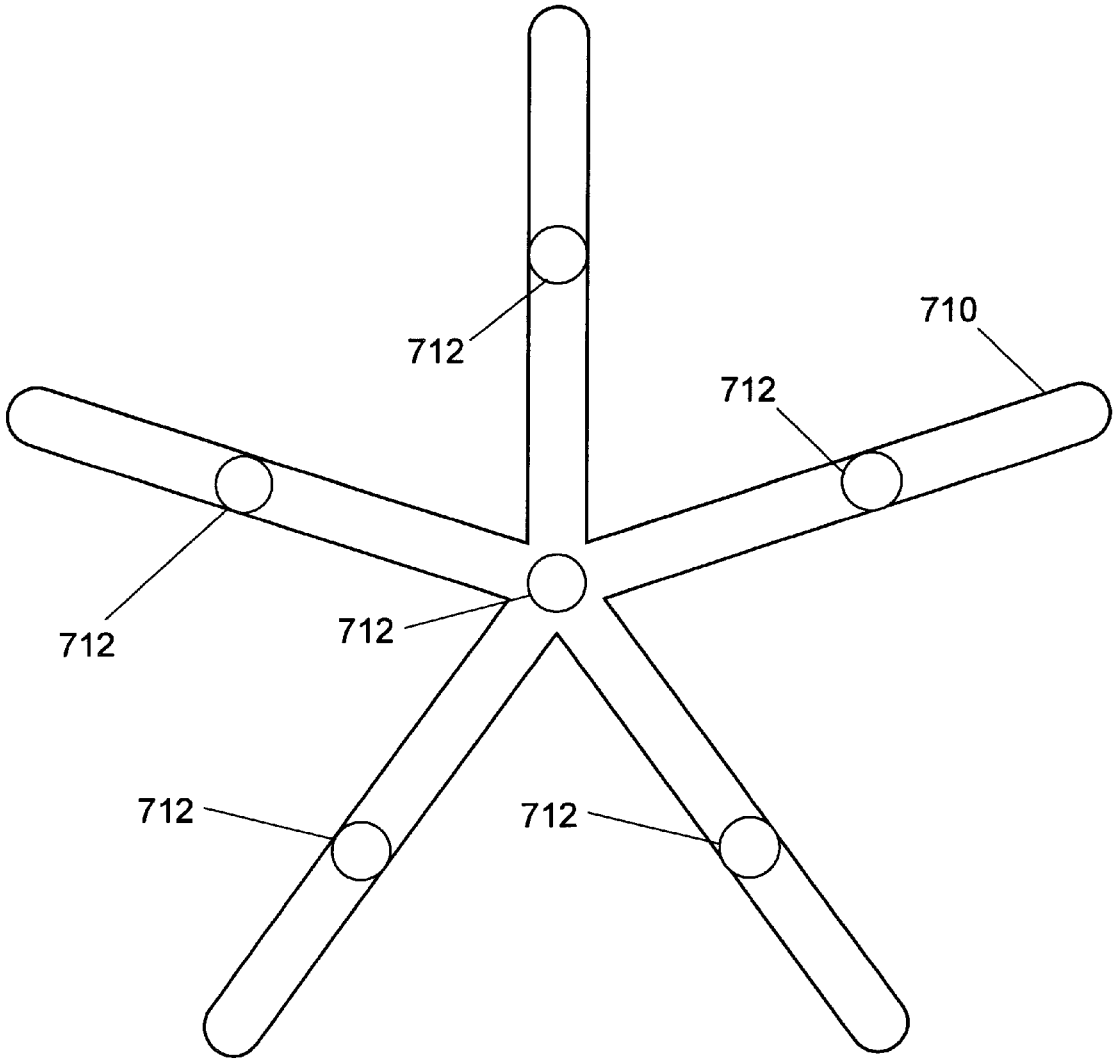

FIG. 8 is a view of a multiple socket base.

Figure 9:
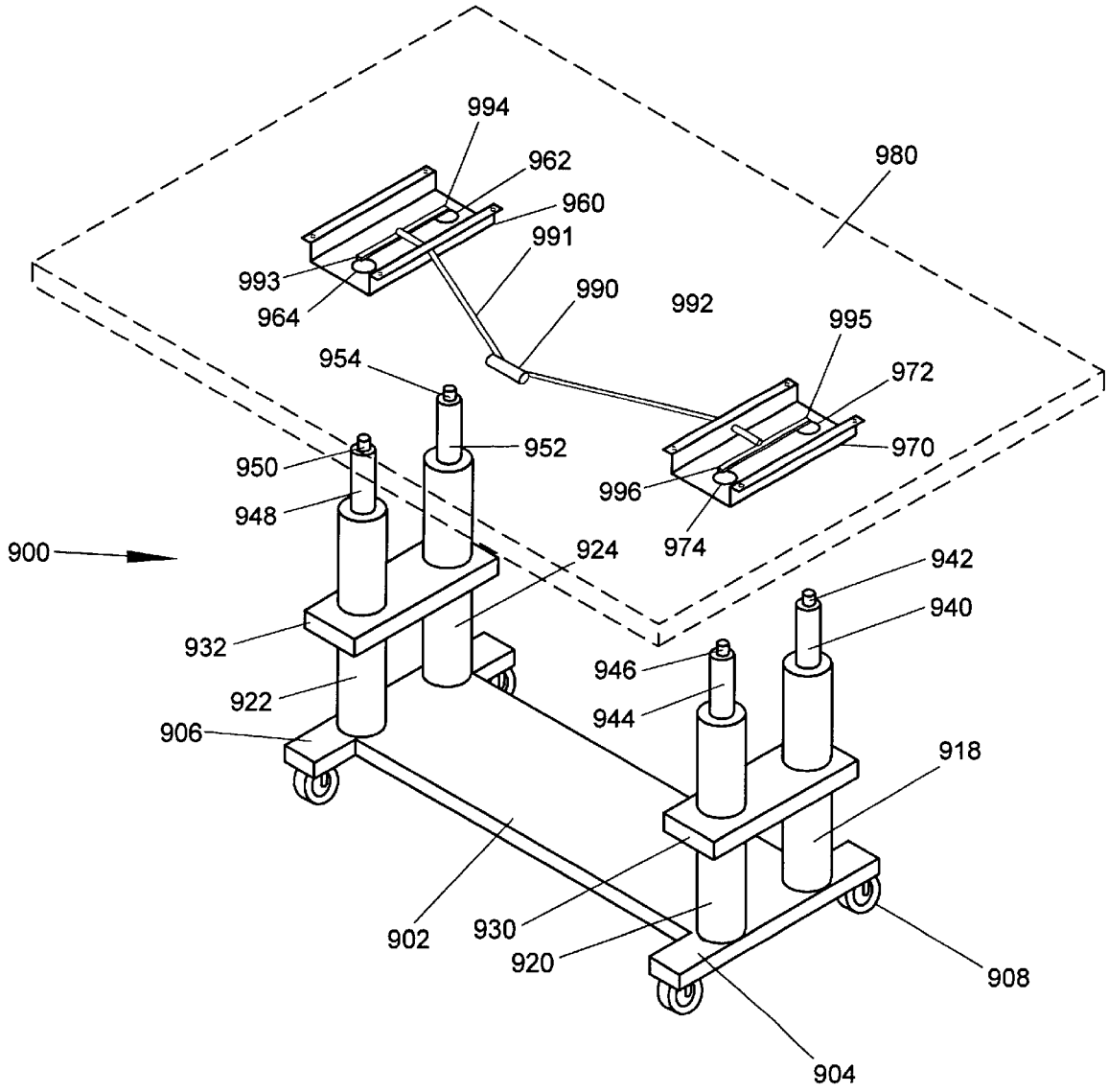

FIG. 9 is an exploded view of a table using a seventh version of the height adjustable pedestal of the present invention.

DESCRIPTION

Figure 1:
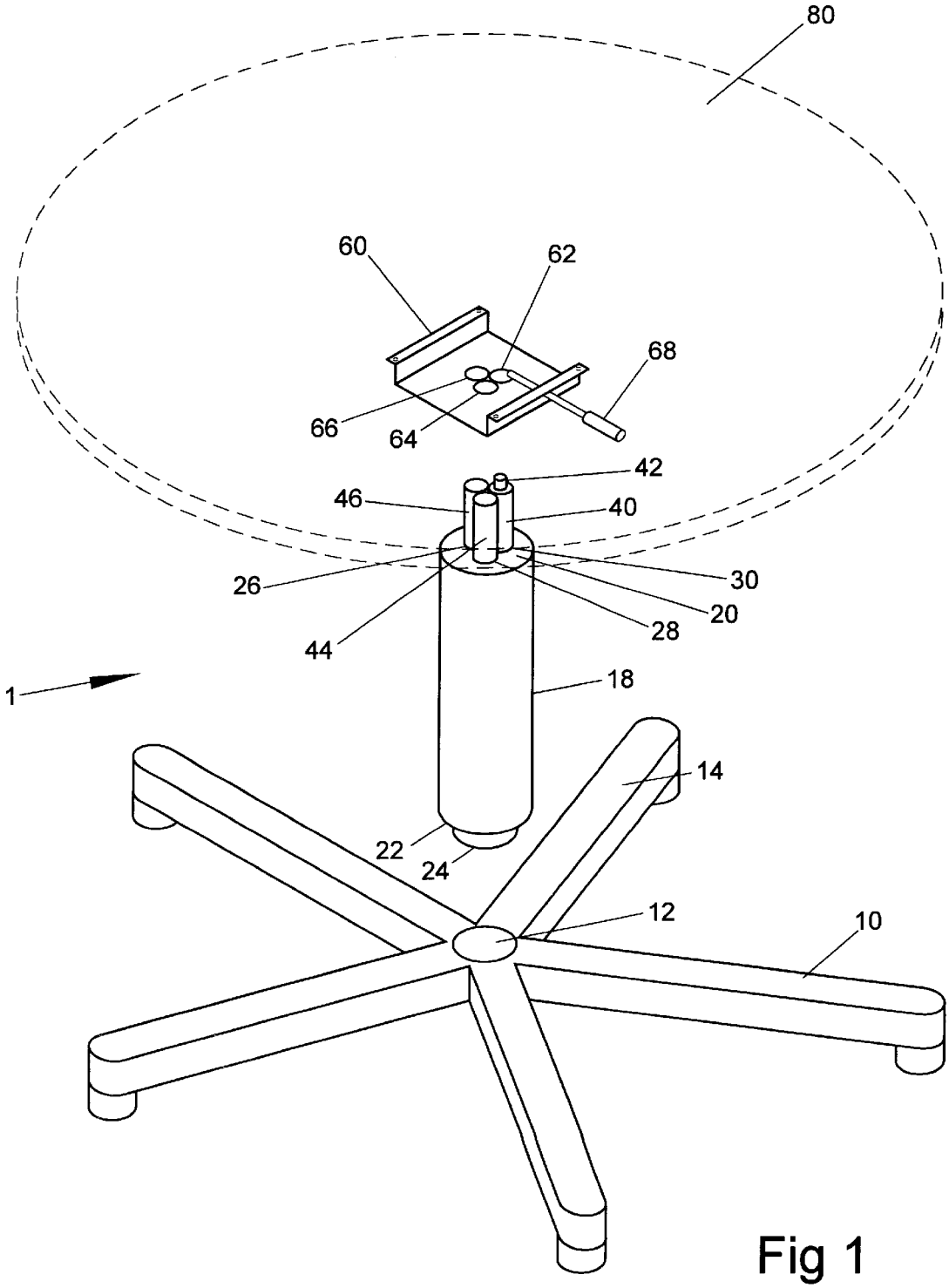
FIG. 1 is an exploded view of a table using a first version of the height adjustable pedestal of the present invention.
Figure 1A:
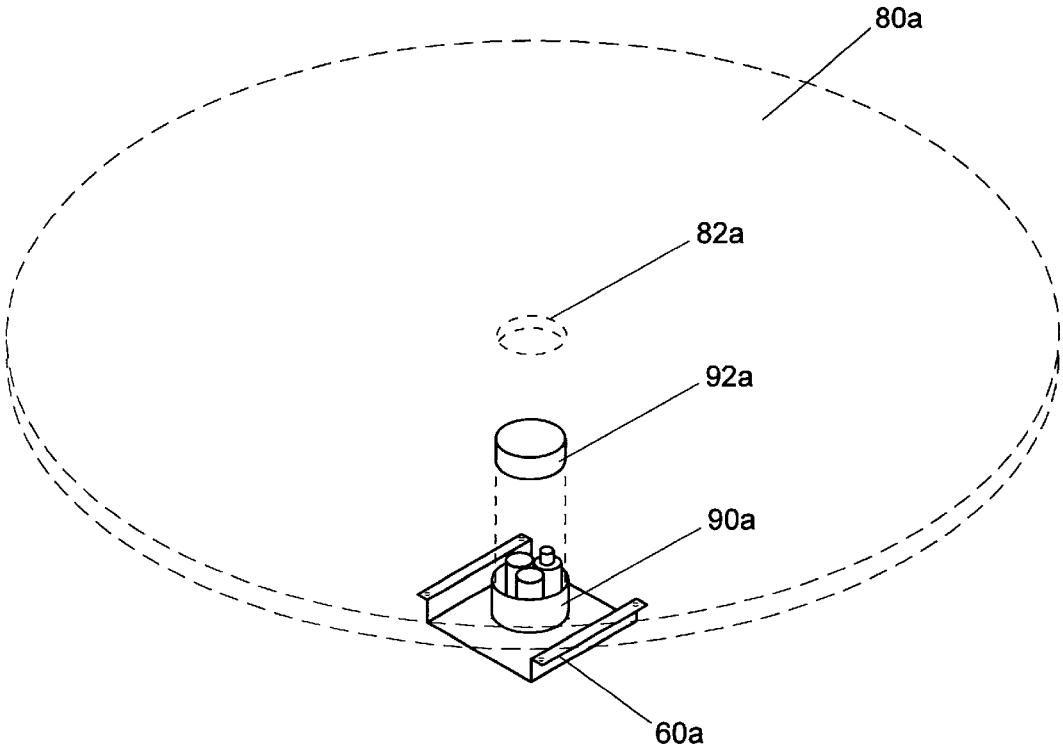

Briefly, FIG. 1 shows an exploded view of a height adjustable table 1 which includes a table top 80, shown in dotted lines, which is supported by a first version of the height adjustable pedestal of the present invention. The height adjustable pedestal includes a height adjustment column which comprises a single stand tube 18 which supports three gas springs 40, 44, and 46. The height adjustable pedestal further includes a base 10 and a table top support 60.

In greater detail, FIG. 1 shows an exploded view of a height adjustable table 1 that includes a base 10 which has five spokes 14 which radiate from a center hub. The center hub includes a socket 12. A single large diameter stand tube 18 which supports three telescoping height adjustment mechanisms comprising gas springs 40, 44, and 46 is supported by the base 10. The stand tube 18 includes a first or top end 20 and a second or bottom end 22. The second end 22 includes a tapered plug 24 which is inserted into the socket 12 of the base during assembly to secure the stand tube 18 to the base 10. The first end 20 includes openings 26, 28, and 30 through which cylinder portions of gas springs 40, 44, and 46 pass.

The stand tube 18 may be a hollow rigid tube having end plates attached at each end. In this version, openings 26, 28, and 30 first allow the insertion of gas springs into the hollow stand tube. The openings additionally serve to support the cylinder portions of gas springs 40, 44, and 46 as well as to guide the gas spring cylinders as the gas spring cylinders move vertically in relation to the stand tube.

In another version, the stand tube may include an internal structure, such as honeycomb (not shown), that is disposed in the tube between the end plates. In this version gas spring passages are created within the internal structure. The openings 26, 28, and 30 allow the insertion of gas springs into the passages during assembly. However the passages serve to both support and guide the cylinder portions of guide springs 40, 44, and 46. In this way, gas springs are supported over a large surface provided by an internal passage which may be beneficial to gas spring structural integrity when compared to the hollow stand tube structure.

In either of these two versions the stand tube can be integral with the base. A single stand tube and base arrangement for supporting a single gas spring of this type is shown in U.S. Pat. No. 5,433,409 which is incorporated herein by this reference.

The height adjustable pedestal additionally includes a table top support 60. The table top support 60, as shown in this figure, is a channel which serves to attach the gas springs of the height adjustment column to the table top 80. The table top support 60 includes openings 62, 64 and 66 which allow the tapered ends of gas spring cylinders 40, 44, and 46 to be secured during assembly. The table top support additionally includes flanges extending from the C shaped channel of the table top support to allow the table top support to be attached to a table top bottom. Many configurations, other than the C-shaped channel, could be used for the table top support. The table top support could also include a tilt mechanism if desired.

The table top support 60 could also use socket type receivers for gas springs which are well known in the art and are often essential in single gas spring pedestals to minimize stress concentrations on the thin walls of the gas spring cylinders. The present invention, which minimizes these stress concentrations by using more than one gas spring, will typically not require the extra manufacturing expense of socket type receivers for most applications.

Supported by the table top support 60 is height adjustment lever 68. Lever 68 toggles between two positions; one which engages gas valve extension 42 of the lockable gas spring 40, and one which does not. Valve extension 42 of gas spring 40 is actuated (or unlocked) by being pushed, pulled, or twisted depending on the manufacture of the device. Once actuated, the table height is able to be adjusted. Should the downward force on the table top exceed the cumulative spring pressure when the valve is actuated, the table will lower. If the downward pressure on the table top is less than the cumulative spring pressure, the table will rise. Once the desired height is achieved, the height adjustment lever 68 is disengaged which locks the lockable gas spring 40 in that vertical position.

Both locking and non-locking gas springs include a gas spring cylinder within which compressed gas is maintained. Extending downwardly from the cylinder is a piston which is typically a small diameter rod. The distal end of the piston is attached to either the stand tube bottom (as is the case in this version) or to that which supports the stand tube, typically the chair base. The downwardly extending piston supports the cylinder in an elevated height adjustable position.

Lockable gas springs also include a valve which typically includes a valve extension extending from the distal end of the gas spring cylinder. This valve extension position is shown at 42 on gas spring 40. When actuated, the valve is unlocked so that vertical movement of the cylinder in relation to the piston is possible. The forces on the gas spring cylinder determine if the cylinder compresses onto the piston or extends therefrom. The gas spring locking mechanism may include an oil chamber through which the piston must move, or may be a valve that prohibits movement of compressed gas when the valve is shut but allows gas movement and subsequent cylinder movement when open. It is understood that locking gas springs serve to lock unlockable gas springs.

An alternative to the gas spring is shown in U.S. Pat. No. 5,078,351. This reference shows a coil spring mechanism that operates similarly to a gas spring. Such coil springs could be used in place of gas springs in the present invention and accordingly, the contents of that patent are incorporated herein by reference.

Gas springs having an extension that includes an integral valve actuation lever may also be used in the various versions of the present invention. The integral valve actuation levers of these gas springs work similarly to the operation of lever 68 previously described. The actuation lever in these gas springs is directly supported by the gas spring extension. Within the height adjustable pedestals of the present invention, the gas spring extension would be supported intermediate the top of the gas spring and the table top support or chair seat support, depending on the use of the pedestal. Accordingly, the table top support or chair seat support would serve to indirectly support the lever, typically immediately beneath the table top support or chair seat support.

The base 10, stand tube 18, and gas springs 40, 44, and 46, along with the table top support 60 comprise a height adjustable pedestal for the table top 80. The table top support in this version further includes the means to actuate the height adjustment mechanism, lever 68, FIG. 1(*a*) shows an alternative version of height actuation mechanism for the table. The height actuation mechanism in FIG 1(*a*) includes a guide sleeve 90*a* which is supported by the table top support 60*a*. Disposed within the guide sleeve 90*a* is a button 92*a* which is able to be moved vertically within the sleeve. The button is further disposed within opening 82*a* of table top 80*a*. In this version, the guide sleeve 90*a* and button 92*a* are centered above the gas springs. Depressing the button 92*a* will press down on the valve extension of any lockable gas springs used in the height adjustable pedestal for the table. This will actuate the internal valve within the lockable gas springs and allow the table top to move vertically.

FIG. 2 shows a table 100 using a second version of the height adjustable pedestal of the present invention. In particular, the height adjustment column in this version comprises three stand tubes, a first stand tube 118 and two additional stand tubes 120 and 122 which are attached to stand tube 118 through attachment brackets 124 and 128.

The first stand tube 118 of the height adjustment column includes a bottom end which is secured within a socket 112 of the base 110 during assembly. Socket 112 may be tapered to receive a tapered end of the stand tube. Attached to the stand tube 118 are stand tubes 120 and 122 which are typically a similar construction to stand tubes 118. As was true of stand tube 18 in FIG. 1, stand tubes 118, 120, and 122 may be either hollow or include an internal structure such as honeycomb, both of which are well known in the art for single stand tubes that support a single gas spring.

Attachment brackets 124 and 128 are the means through which stand tube 118 supports stand tubes 120 and 122. Attachment bracket 124 includes stand tube holes 125, 126, and 127. Similarly, attachment bracket 128 includes stand tube holes 129, 130, and 131. The attachment brackets could be molded plastic members that serve to secure the stand tubes together or could be metal plates which would allow metal stand tubes to be welded together through the attachment brackets. A cover (not shown) could be included to the assembly which would extend from the attachment bracket 124 to attachment bracket 128 which could provide a desired cosmetic appearance for the height adjustable column. The cover could also provide additional structural support to the assembly if necessary.

The height adjustment column of FIG. 2 is disposed between a base 110 and a table top support 160 which are similar to that shown in FIG. 1.

FIG. 2 also shows the inclusion of a controlled swivel mechanism 190 which provides users of height adjustable table 100 the ability to make rotational adjustments, as well. A control mechanism serves to frictionally control the degree of swivel. Table swivel can be adjusted from free swivel to no swivel. The mechanism will be described in the description of FIG. 7.

FIG. 2*a* shows a side view of the stand tube 118 in cross section supporting the gas spring cylinder 140. In particular, stand tube 118 is shown in a hollow configuration and includes an opening 129 through which the gas spring cylinder extends and within which the gas spring is supported by the stand tube 118. FIG. 2*a* further shows how a piston 141 extends from the bottom of the gas spring cylinder 140 and how the end of the piston can be secured to the bottom of the stand tube through a clip 143. Many other arrangements are possible for the attachment of the piston to the stand tube. The gas spring is shown in a locking version and also includes a valve (not shown) internal of the gas spring cylinder 140. A valve extension 142 is shown extending from the distal end of the gas spring cylinder opposite the piston.

Although the spring actuated telescoping height adjustment mechanism shown in FIG. 2*a* is identified as a gas spring, it is understood that springs other than pressurized gas could be used in the mechanism. As was previously mentioned, U.S. Pat. No. 5,078,351 shows how a metal coil spring can be used in telescoping height adjustment mechanisms. Other springs that may be used include elastomeric materials and microcellular foam materials, both of which are well known for suitability as a spring.

FIG. 3 shows a work station table 200 using a third version of the height adjustable pedestal of the present invention. In particular, the height adjustment column of this version comprises three stand tubes, a first stand tube 218, and second and third stand tubes 220 and 222. Stand tube 218 extends through socket 212 of base 210. A platform 224 is secured to the bottom of stand tube 218 at a position under the base spokes 214. Extending from the platform are second and third stand tubes 220 and 222 which are secured to the platform either by a permanent attachment such as welding or more typically by the inclusion of openings or sockets in the platform that receive the additional stand tubes and allow for easy assembly and disassembly.

Gas springs 240, 244, and 246 are disposed in the stand tubes in a manner as has been described in FIGS. 1 and 2. The gas springs are disposed within openings 262, 264, and 266 of table top support 260. Locking gas spring 240 includes a valve extension 242 which is actuated by height adjustment lever 268. A work station table top 280 is supported on the height adjustable pedestal and is shown exploded above the height adjustable pedestal in dotted lines. The table top 280 would typically be centered on the pedestal. This arrangement has been distorted by the exploded rendering used in this figure.

FIG. 4*a* shows a table 300 which includes a fourth version of the height adjustable pedestal of the present invention. In particular, the height adjustment column of this version comprises five stand tubes, a center stand tube 318 and four outside stand tubes 320, 322, 324, and 326. A platform 315 which includes a center opening 316 and four outside openings 317 serves to attach the four outside stand tubes to the center stand tube 318. The center stand tube in this version passes through the platform 315 at opening 316 so as to be secured within a bas center socket during assembly. Additionally, stand tubes 320, 322, 324, and 326 are secured within the four outside openings 317. Again, openings 316 and 317 may include tapered sockets extending downwardly therefrom if desired. Alternatively, the platform may be attached directly to the base without securement stand tube 318.

FIG. 4*a* additionally shows the inclusion of an attachment bracket 334 in the height adjustment column. The attachment bracket secures the four outside stand tube together in this arrangement. Supported by the five stand tubes are gas springs 340, 344, 346, 348, and 350. Table 300 additionally includes a table support 360, swivel mechanism 390, and a table top 380 in a similar arrangement as was described in FIGS. 1–3.

FIG. 4*b* shows how the attachment bracket 334 may additionally support a foot support ring 336 which is spaced from the attachment bracket 334 by spokes 338. FIG. 4*b* additionally shows the stand tubes assembled into the platform 315.

FIGS. 5 and 6 show height adjustable pedestals according to the present invention utilized in height adjustable chairs.

In particular, FIG. 5 shows a height adjustable pedestal similar to the height adjustable pedestal used in the table 100 shown in FIG. 2. The height adjustment column of this version of the height adjustable pedestal comprises a first stand tube 418, and second and third stand tubes 420 and 422, which are attached to first stand tube 418 through attachment bracket 424. Stand tube 418 is secured to base 410 through the insertion of the bottom of the stand tube into the socket 412. Attachment brackets 424 and 428 secure stand tubes 420 and 422 to stand tube 418. Attachment bracket 424 includes stand tube holes (not shown) for the passage of stand tubes 418, 420, and 422. A second attachment bracket 428 includes stand tube holes 429, 430, and 431 for the passage of stand tubes 418, 420, and 422. A cosmetic panel 432 is shown disposed between the two attachment brackets.

Gas springs 440, 444, and 446 are supported by the stand tubes. A seat support 460 which includes gas spring cylinder mounting holes 462, 464, and 466 serves to attach the height adjustable pedestal to the chair seat 480. Seat support 460 also supports the height adjustment lever 468 which engages gas spring valve extension 442 of gas spring 440. Also included into the chair 400 is a controlled swivel mechanism 490 which will be described further in FIG. 7.

FIG. 6 shows a sixth height adjustment pedestal utilized in the height adjustable chair 500. The height adjustable pedestal includes: a two socket base 510; a height adjustment column comprising stand tubes 518 and 520 attached by attachment bracket 522, and two lockable gas springs 540 and 544; and seat support 560.

Base 510 includes a center hub 511 with two sockets 512 and 513 and five spokes 514 radiating from the center hub. Optional attachment bracket 522 forms an additional attachment support for stand tubes 518 and 520 and includes stand tube holes 524 and 526. Seat support 560 includes mounting holes 562 and 564 for the tapered ends of gas spring cylinders 540 and 544. Again, these openings could include sockets if desired. Height adjustment lever 566, which includes a t-bar end 568, is also supported by the seat support 560. The height adjustment lever t-bar end 568 engages valve extensions 542 and 546 simultaneously.

FIG. 6 shows how more than one lockable gas spring can be used in a single height adjustable pedestal. A similar use of two or more lockable gas springs could have also been used in any of the previously described pedestals.

FIG. 7 shows the construction of the controlled swivel mechanism 690. The mechanism includes opposing top and bottom plates 692 and 694 which are separated by a series of bearings 696 that are held at spaced intervals by bearing retainer. A swivel control screw 698 is supported by flange 699 of top plate 692. The swivel control screw 698 bears against the lower plate 694 which is attached to either a table top or chair seat support. The top plate supports either a chair seat or a table top. Accordingly, the swivel control screw 698 allows the degree of swivel between the chair seat or table top and the height adjustable pedestal to be adjustable. The adjustment possible is from a situation of "free swivel" where there is no contact between screw 698 and bottom plate 694, to "no swivel" when the screw 698 is secured tightly against the bottom plate 694. Although not shown, low friction materials such as ultra high molecular weight polyethylene could also be used as the bearing in the swivel mechanism.

FIG. 8 shows one of many possible base configurations using more than one stand tube socket. This particular base 710 would likely be used in a height adjustable table that supports a heavy load. Sockets 712 could also be located between spokes if desired. The plurality of stand tubes depending from such a base could be covered with a cosmetic cover as was previously mentioned to give the appearance of a unified single stand tube within the pedestal. For example, the base 710 could have been in place of the base 310 and platform 315 shown in FIG. 4*a*.

FIG. 9 shows a height adjustable table 900 that is constructed with yet another version of the height adjustable pedestal of the present invention. In this version, the base 902 includes a center section and two end sections 904 and 906 supported by casters 908. The base 902 supports four stand tubes 918, 920, 922, and 924 which extend vertically from the base. Locking gas spring 940 is supported by stand tube 918. Gas spring 940 further includes valve extension 942. Locking gas springs 944, 948, and 952 are similarly supported by stand tubes 920, 922, and 924. Locking gas springs 944, 948, and 952 also similarly include valve extensions 946, 950, and 954. Optional attachment brackets 930 and 932 may be included into the pedestal if desired for additional structural strength or cosmetic effect. Cosmetic covers (not shown) could also surround the stand tubes if desired.

Table top support mechanism 960 is supported by the telescoping height adjustment mechanisms comprising stand tubes 922 and 924, and locking gas springs 948 and 952. Similarly, table top support mechanism 970 is supported by the telescoping height adjustment mechanisms comprising stand tubes 918 and 920, and locking gas springs 940 and 944. The four telescoping height adjustment mechanisms comprise a height adjustment column for the pedestal which supports the table tops 980 through the included table top support mechanisms 960 and 970.

Table top support mechanism 960 includes openings 962 and 964 which allow gas springs 948 and 952 to be secured during assembly. Similarly, table top support mechanism 970 includes openings 972 and 974 for securement of gas springs 940 and 944. Again, openings 962, 964, 972, and 974 could be replaced by sockets as was earlier described. A single table top support could also have been used in the place of mechanisms 960 and 970. Tilt mechanisms could also have been included into the mechanisms 960 and 970 for use as a drafting table.

Height adjustment lever 990 which includes two arms 991 and 992 is used for height adjustment actuation. Height adjustment lever 990 comprises the means to actuate the height adjustment mechanisms and comprises a lever that toggles between a first position wherein the gas flow control valve of each lockable telescoping height adjustment mechanism is not actuated and a second position wherein the gas flow control valve of each lockable telescoping height adjustment mechanism is actuated. Arm 991 includes T ends 993 and 994. Arm 992 includes T ends 995 and 996. The T ends engage valve extensions 942, 946, 950, and 954 simultaneously when lever 990 is toggled which allows the table to rise or fall depending on the force acting on the table top as was previously described. Although four locking gas springs are shown in this version, the pedestal could have used fewer locking gas springs. In an alternative version the table would use locking means other than locking gas springs.

Table top 980 is a common rectangular table top for use in homes, offices, schools, and industry. Different table tops other than that shown could be used with the height adjustable pedestal of this version of the invention. Examples would be a corner type table for use with opposite credenzas if desired, or a work station type table top.

The base 902 could be used for feet support and could be specially designed for this purpose.

FIGS. 1–9 have been shown in exploded views to demonstrate the modular nature of the invention. Accordingly, the elements of each version are for the most part easily used in different versions. The FIGS. 1–9 also represent the easy assembly of the chairs and tables that are constructed according to the teachings of the invention. The chair elements could be manufactured by the cost effective techniques in use in the chair and table manufacturing industry. Additionally, the chairs and tables of the invention could be easily shipped unassembled as is customary in the industry and assembled by retail sales personnel with the ease that they are accustomed.

The chairs and tables of the invention allow low cost components and low cost assembly techniques to be used to construct high quality finished products that are both sturdy, safe, and visually appealing. The significant safety benefits, detailed earlier, are a result of the even distribution of stresses in each of the table or chair components. This design is of particular importance to the integrity of gas spring mechanisms which are most susceptible to catastrophic failures.

The tables and chairs constructed with the height adjustment pedestals of the present invention offer ease of use and ease in height adjustment. The simple procedures required for height adjustment have been incorporated into the preceding description.

It is understood that other various modifications and changes in form or detail could readily be made without departing from the spirit of the invention. An example of such a modification would be the inclusion of a desk top attached to the chair seat for educational applications. Many other such modifications have been previously mentioned within the description of the invention. It is therefore intended that the invention be not limited to the exact form and detail herein shown and described, nor to anything less than the whole of the invention herein disclosed and as hereinafter claimed.

What is claimed is:

1. A height adjustable table comprising:

a floor contacting base including a first base section, and a second base section;

a first height adjustable column disposed vertically above the first base section and supported by the first base section; and wherein the first height adjustable column includes a first portion attached to the first base section;

a second height adjustable column disposed vertically above the second base section and supported by the second base section; and wherein the second height adjustable column includes a first portion attached to the second base section;

wherein the first height adjustable column comprises at least a first telescoping spring height adjustment lifting mechanism;

and wherein the second height adjustable column includes at least a first telescoping spring height adjustment lifting mechanism;

a table top support disposed vertically above the first and second height adjustable columns and supported by the first and second height adjustable columns; wherein the table top support is adapted for support of a table top;

a table top disposed vertically above the table top support and supported by the table top support;

wherein each telescoping spring height adjustment lifting mechanism includes a resilient spring material; and wherein at least one telescoping spring height adjustment lifting mechanism is lockable; and wherein each lockable spring height adjustment lifting mechanism includes a movable actuation button, and wherein the movable actuation button is selectively movable from a first locked position to a second unlocked position; and, wherein each lockable telescoping spring height adjustment lifting mechanism must be actuated to adjust the height of the table top relative to the floor;

an actuation mechanism supported by the height adjustment table for engaging and moving the actuation button of each lockable telescoping spring height adjustment lifting mechanism to the second unlocked position;

and, wherein upon the actuation of each lockable telescoping spring height adjustment lifting mechanism, the resilient spring material of each telescoping spring height adjustment lifting mechanism may be compressed; and wherein upon actuation the resilient spring material of each telescoping spring height adjustment lifting mechanism, if compressed, will resiliently expand unless a sufficient compressive force is applied to the telescoping spring height adjustment lifting mechanisms;

wherein the telescoping spring height adjustment lifting mechanisms of the first and second height adjustable columns are sealed against the introduction or loss of spring material during regular use within the table, which includes periods of height adjustment when the lockable telescoping spring height adjustment lifting mechanisms are actuated; and wherein the spring material of each telescoping spring height adjustment lifting mechanism is independent of the spring material of any other telescoping spring height adjustment lifting mechanisms in the height adjustable table; and wherein the actuation and resilient expansion of compressed spring material of each of the telescoping spring height adjustment lifting mechanisms results in an upward force applied to the table top causing the rising of the table top; and wherein each telescoping spring height adjustment lifting mechanism contributes significantly to the lifting forces applied to the table top; and wherein the first base section and the second base section do not move vertically relative to the floor during height adjustments; and, wherein the first portion of the first height adjustable column does not move relative to the first base section; and wherein the first portion of the second height adjustable column does not move relativer to the second base section.

2. The height adjustable table of claim 1, wherein the actuation mechanism is supported by the table top support.

3. The height adjustable table of claim 1, wherein the first telescoping spring height adjustment lifting mechanism of the first and second height adjustable columns is lockable.

4. The height adjustable table of claim 1, wherein the table top support comprises first and second table top support sections, wherein the first table top support section is disposed between the first height adjustable column and the table top, and wherein the second table top support section is disposed between the second height adjustable column and the table top; and wherein the second table top support section is disposed at a spaced apart distance from the first table top support section.

5. The height adjustable table of claim 4, wherein the table top includes a length and a depth;

and wherein the first and second base sections are disposed generally orthogonally to the length and generally parallel to the depth.

6. The height adjustable table of claim 1, wherein each telescoping spring height adjustment lifting mechanism comprises a first telescoping section, a second telescoping section, and a resilient spring disposed within the telescoping spring height adjustment lifting mechanism; and wherein each lockable telescoping spring height adjustment lifting mechanism comprises a first telescoping section, a second telescoping section, a resilient spring disposed within the telescoping spring height adjustment lifting mechanism, and movable actuation button disposed on the lockable telescoping spring height adjustment lifting mechanism; wherein the actuation button, when moved, unlocks the lockable telescoping spring height adjustment lifting mechanism allowing relative movement between the first and second telescoping sections.

7. The height adjustable table of claim 1, wherein each telescoping spring height adjustment lifting mechanism comprises a gas spring which comprises:

a cylinder, a piston disposed within the cylinder and extending therefrom to a secured position opposite the cylinder in the height adjustable column, and a spring comprising pressurized gas disposed within the cylinder; and wherein each locking telescoping spring height adjustment lifting mechanism comprises a gas spring which comprises:

a cylinder, a piston disposed within the cylinder and extending therefrom to a secured position opposite the cylinder in the height adjustable column, a spring comprising pressurized gas disposed within the cylinder, and an actuation button comprising a gas flow control valve extension actuation button that extends outwardly from the gas spring.

8. The height adjustable table of claim 1, wherein the actuation mechanism for engaging and moving the actuation button of each lockable telescoping spring height adjustment lifting mechanism is a height adjustment lever having ends which extend to the actuation button of each lockable telescoping spring height adjustment lifting mechanism.

9. The height adjustable table of claim 1, wherein the actuation mechanism for engaging and moving the actuation button of each lockable telescoping spring height adjustment lifting mechanism is a height adjustment lever which includes connected lever arms having ends which extend to the actuation button of each lockable telescoping spring height adjustment lifting mechanism.

10. The height adjustable table of claim 1, wherein the table further includes a center base section which connects the first and second base sections.

11. The height adjustable table of claim 1, wherein each height adjustable column includes at least one stand tube; and wherein each telescoping spring height adjustment lifting mechanism is supported by a stand tube; and wherein each telescoping spring height adjustment lifting mechanism includes a portion which extends between the stand tube and the table top support; and, wherein any downward force applied to the table top will be transferred directly through the telescoping spring height adjustment lifting mechanisms.

12. The height adjustable table of claim 1, further including at least one support element for connecting the at least two height adjustable columns together.

13. The height adjustable table of claim 1, further including a swivel mechanism disposed between the table top and the table top support mechanism; wherein the swivel mechanism includes an upper plate, a lower plate, and a low friction bearing assembly separating the upper and lower plates; and wherein the swivel mechanism further includes a frictional swivel control means for selectively controlling the ease of swivel in the swivel mechanism.

14. The height adjustable table of claim 1, wherein the actuation mechanism is supported by the table top.

15. The height adjustable table of claim 1, wherein the actuation mechanism is supported by the actuation button disposed on each lockable telescoping spring height adjustment lifting mechanism.

16. A height adjustable pedestal comprising:

a floor contacting base including a first base section, and a second base section;

a first height adjustable column disposed vertically above the first base section and supported by the first base section; and wherein the first height adjustable column includes a first portion attached to the first base section;

a second height adjustable column disposed vertically above the second base section and supported by the second base section; and wherein the second height adjustable column includes a first portion attached to the second base section;

wherein the first height adjustable column comprises at least a first telescoping spring height adjustment lifting mechanism;

and wherein the second height adjustable column includes at least a first telescoping spring height adjustment lifting mechanism;

a furniture component support disposed vertically above the first and second height adjustable columns and supported by the first and second height adjustable columns; wherein the furniture component support is adapted for support of a furniture component;

wherein each telescoping spring height adjustment lifting mechanism includes a resilient spring material; and wherein at least one telescoping spring height adjustment lifting mechanism is lockable; and wherein each lockable spring height adjustment lifting mechanism includes a movable actuation button, and wherein the movable actuation button is selectively movable from a first locked position to a second unlocked position; and, wherein each lockable telescoping spring height adjustment lifting mechanism must be actuated to adjust the height of the furniture component support relative to the floor;

an actuation mechanism supported by the height adjustable pedestal for engaging and moving the actuation button of each lockable telescoping spring height adjustment lifting mechanism to the second unlocked position;

and, wherein upon the actuation of each lockable telescoping spring height adjustment lifting mechanism, the resilient spring material of each telescoping spring height adjustment lifting mechanism may be compressed; and wherein upon actuation the resilient spring material of each telescoping spring height adjustment lifting mechanism, if compressed, will resiliently expand unless a sufficient compressive force is applied to the telescoping spring height adjustment lifting mechanisms;

wherein the telescoping spring height adjustment lifting mechanisms of the first and second height adjustable columns are sealed against the introduction or loss of spring material during regular use within the pedestal, which includes periods of height adjustment when the lockable telescoping spring height adjustment lifting mechanisms are actuated; and wherein the spring material of each telescoping spring height adjustment lifting mechanism is independent of the spring material of any other telescoping spring height adjustment lifting mechanisms in the height adjustable pedestal; and wherein the actuation and resilient expansion of compressed spring material of each of the telescoping spring height adjustment lifting mechanisms results in an upward force applied to the furniture component support causing the rising of the furniture component support; and wherein each telescoping spring height adjustment lifting mechanism contributes significantly to the lifting forces applied to the furniture component support; and wherein the first base section and the second base section do not move vertically relative to the floor during height adjustments; and, wherein the first portion of the first height adjustable column does not move relative to the first base section; and wherein the first portion of the second height adjustable column does not move relative to the second base section.

17. The height adjustable pedestal of claim 16, wherein the actuation mechanism is supported by the furniture component support.

18. The height adjustable pedestal of claim 16, wherein the first telescoping spring height adjustment lifting mechanism of the first and second height adjustable columns is lockable.

19. The height adjustable pedestal of claim 16, wherein the furniture component support comprises a table top support; and wherein the table top support comprises first and second table top support sections, wherein the first table top support section is disposed above the first height adjustable column, and wherein the second table top support section is disposed above the second height adjustable column; and wherein the second table top support section is disposed at a spaced apart distance from the first table top support section.

20. The height adjustable pedestal of claim 19, wherein the height adjustable pedestal includes a length and a depth;

and wherein the first and second base sections are disposed generally orthogonally to the length and generally parallel to the depth.

21. The height adjustable pedestal of claim 16, wherein each telescoping spring height adjustment lifting mechanism comprises a first telescoping section, a second telescoping section, and a resilient spring disposed within the telescoping spring height adjustment lifting mechanism; and wherein each lockable telescoping spring height adjustment lifting mechanism comprises a first telescoping section, a second telescoping section, a resilient spring disposed within the telescoping spring height adjustment lifting mechanism, and an actuation button disposed on the lockable telescoping spring height adjustment lifting mechanism; wherein the actuation button, when moved, unlocks the lockable telescoping spring height adjustment lifting mechanism allowing the relative movement between the first and second telescoping sections.

22. The height adjustable pedestal of claim 16, wherein each telescoping spring height adjustment lifting mechanism comprises a gas spring which comprises:

a cylinder, a piston disposed within the cylinder and extending therefrom to a secured position opposite the cylinder in the height adjustable column, and a spring comprising pressurized gas disposed within the cylinder; and wherein each locking telescoping spring height adjustment lifting mechanism comprises a gas spring which comprises:

a cylinder, a piston disposed with the cylinder and extending therefrom to a secured position opposite the cylinder in the height adjustable column, a spring comprising pressurized gas disposed within the cylinder, and an actuation button comprising a gas flow control valve extension actuation button that extends outwardly from the gas spring.

23. The height adjustable pedestal of claim 16, wherein the actuation mechanism for engaging and moving the actuation button of each lockable telescoping spring height adjustment lifting mechanism is a height adjustment lever having ends which extend to the actuation button of each lockable telescoping spring height adjustment lifting mechanism.

24. The height adjustable pedestal of claim 16, wherein the actuation mechanism for engaging and moving the actuation button of each lockable telescoping spring height adjustment lifting mechanism is a height adjustment lever which includes connected lever arms having ends which extend to the actuation button of each lockable telescoping spring height adjustment lifting mechanism.

25. The height adjustable pedestal of claim 16, wherein the pedestal further includes a center base section which connects the first and second base sections.

26. The height adjustable pedestal of claim 16, wherein each height adjustable column includes at least one stand tube; and wherein each telescoping spring height adjustment lifting mechanism is supported by a stand tube; and wherein each telescoping spring height adjustment lifting mechanism includes a portion which extends between the stand tube and the furniture component support; wherein any downward force applied to the furniture component support will be transferred directly through the telescoping spring mechanisms.

27. The height adjustable pedestal of claim 16, further including at least one support element for connecting at least two height adjustable columns together.

28. The height adjustable pedestal of claim 16, further including a swivel mechanism disposed above the furniture component support; wherein the swivel mechanism includes an upper plate, a lower plate, and a low friction bearing assembly separating the upper and lower plates; and wherein the swivel mechanism further includes a frictional swivel control means for selectively controlling the ease of swivel in the swivel mechanism.

29. The height adjustable pedestal of claim 16, further comprising a table top disposed above the furniture component support; and wherein the actuation mechanism is supported by the table top.

30. The height adjustable pedestal of claim 16, wherein the actuation mechanism is supported by the actuation button disposed on each lockable telescoping spring height adjustment lifting mechanism.

31. A height adjustable pedestal comprising:

a floor contacting base;

a height adjustable column disposed vertically above the base and supported by the base; and wherein the height adjustable column includes a first portion attached to the base;

wherein the height adjustable column comprises at least first and second telescoping spring height adjustment lifting mechanisms;

a furniture component support disposed vertically above the height adjustable column and supported by the height adjustable column; wherein the furniture component support is adapted for support of a furniture component;

wherein each telescoping spring height adjustment lifting mechanism includes a resilient spring material; and wherein at least one telescoping spring height adjustment lifting mechanism is lockable; and wherein each lockable spring height adjustment lifting mechanism includes a movable actuation button, and wherein the movable actuation button is selectively movable from a first locked position to a second unlocked position; and, wherein each lockable telescoping spring height adjustment lifting mechanism must be actuated to adjust the height of the furniture component support relative to the floor;

an actuation mechanism supported by the height adjustable pedestal for engaging and moving the actuation button of each lockable telescoping spring height adjustment lifting mechanism to the second unlocked position; and, wherein upon the actuation of each lockable telescoping spring height adjustment lifting mechanism, the resilient spring material of each telescoping spring height adjustment lifting mechanism may be compressed; and wherein upon actuation the resilient spring material of each telescoping spring height adjustment lifting mechanism, if compressed, will resiliently expand unless a sufficient compressive force is applied to the telescoping spring height adjustment lifting mechanisms;

wherein the telescoping spring height adjustment lifting mechanisms of the height adjustable column are sealed against the introduction or loss of material during regular use within the pedestal, which includes periods of height adjustment when the lockable telescoping spring height adjustment lifting mechanisms are actuated; and wherein the spring material of each telescoping spring height adjustment lifting mechanism is independent of the spring material of any other telescoping spring height adjustment lifting mechanisms in the height adjustable pedestal; and wherein the actuation and resilient expansion of compressed spring material of each of the telescoping spring height adjustment lifting mechanisms results in an upward force applied to the furniture component support causing the rising of the furniture component support; and wherein each telescoping spring height adjustment lifting mechanism contributes significantly to the lifting forces applied to the furniture component support; and wherein the first and second height adjustment lifting mechanisms each include a first portion which does not move relative to the base.

32. The height adjustable pedestal of claim 31, wherein the actuation mechanism is supported by the furniture component support.

33. The height adjustable pedestal of claim 31, wherein the first and second telescoping spring height adjustment lifting mechanisms are lockable.

34. The height adjustable pedestal of claim 31, wherein the furniture component support comprises a table top support.

35. The height adjustable pedestal of claim 31, wherein each telescoping spring height adjustment lifting mechanism comprises a first telescoping section, a second telescoping section, and a resilient spring disposed within the telescoping spring height adjustment lifting mechanism; and wherein each lockable telescoping spring height adjustment lifting mechanism comprises a first telescoping section, a second telescoping section, a resilient spring disposed within the telescoping spring height adjustment lifting mechanism, and an actuation button disposed on the lockable telescoping spring height adjustment lifting mechanism; wherein the actuation button, when moved, unlocks the lockable telescoping spring height adjustment lifting mechanism allowing the relative movement of the first and second telescoping sections.

36. The height adjustable pedestal of claim 31, wherein each telescoping spring height adjustment lifting mechanism comprises a gas spring which comprises:

a cylinder, a piston disposed within the cylinder and extending therefrom to a secured position opposite the cylinder in the height adjustable column, and a spring comprising pressurized gas disposed within the cylinder; and wherein each locking telescoping spring height adjustment lifting mechanism comprises a gas spring which comprises:

a cylinder, a piston disposed within the cylinder and extending therefrom to a secured position opposite the cylinder in the height adjustable column, a spring comprising pressurized gas disposed within the cylinder, and an actuation button comprising a gas flow control valve extension actuation button that extends outwardly from the gas spring.

37. The height adjustable pedestal of claim 31, wherein the actuation mechanism for engaging and moving the actuation button of each lockable telescoping spring height adjustment lifting mechanism is a height adjustment lever having ends which extend to the actuation button of each lockable telescoping spring height adjustment lifting mechanism.

38. The height adjustable pedestal of claim 31, wherein the actuation mechanism for engaging and moving the actuation button of each lockable telescoping spring height adjustment lifting mechanism is a height adjustment lever which includes connected lever arms having ends which extend to the actuation button of each lockable telescoping spring height adjustment lifting mechanism.

39. The height adjustable pedestal of claim 31, wherein the furniture component support comprises a chair set support mechanism.

40. The height adjustable pedestal of claim 31, further including a swivel mechanism disposed above the furniture component support; wherein the swivel mechanism includes an upper plate, a lower plate, and a low friction bearing assembly separating the upper and lower plates; and wherein the swivel mechanism further includes a frictional swivel control means for selectively controlling the ease of swivel in the swivel mechanism.

41. The height adjustable pedestal of claim 31, wherein the height adjustable column includes at least one stand tube; and wherein each telescoping spring height adjustment lifting mechanism is supported by a stand tube; and wherein each telescoping spring height adjustment lifting mechanism includes a portion which extends between the stand tube and the furniture component support; wherein any downward force applied to the furniture component support will be transferred directly through the telescoping spring height adjustment lifting mechanisms.

42. The height adjustable pedestal of claim 31, wherein the height adjustable pedestal includes a single stand tube; and each telescoping spring height adjustment lifting mechanism is supported by the single stand tube.

43. The height adjustable pedestal of claim 31, further including at least two stand tubes and further including at least one support element for connecting at the least two stand tubes together.

44. The height adjustable pedestal of claim 43, wherein the at least one support element for connecting at least two stand tubes together comprises a platform disposed proximate to the base.

45. The height adjustable pedestal of claim 31, further comprising a table top disposed above the furniture component support; and wherein the actuation mechanism is supported by the table top.

46. The height adjustable pedestal of claim 31, wherein the actuation mechanism is supported by the actuation button disposed on each lockable telescoping spring height adjustment lifting mechanism.

47. A height adjustable pedestal comprising:

a floor contacting base including a first base section, and a second base section;

a first height adjustable column disposed vertically above the first base section and supported by the first base section; and wherein the first height adjustable column includes a first portion attached to the first base section;

a second height adjustable column disposed vertically above the second base section and supported by the second base section; and wherein the second height adjustable column includes a first portion attached to the second base section;

wherein the first height adjustable column comprises a first lockable telescoping spring height adjustment lifting mechanism;

and wherein the second height adjustable column comprises a first lockable telescoping spring height adjustment lifting mechanism;

a furniture component support disposed vertically above to first and second height adjustable columns and supported by the first and second height adjustable columns; wherein the furniture component support is adapted for support of a furniture component;

wherein each telescoping spring height adjustment lifting mechanism includes a resilient spring material; and, wherein the first lockable spring height adjustment lifting mechanisms of the first and second height adjustable columns include a movable actuation button, and wherein the movable actuation button is selectively movable from a first locked position to a second unlocked position; and, wherein the first lockable telescoping spring height adjustment lifting mechanisms must be actuated to adjust the height of the furniture component support relative to the floor;

an actuation mechanism supported by the height adjustable pedestal for engaging and moving the actuation button of the first lockable telescoping spring height adjustment lifting mechanisms to the second unlocking position;

and, wherein upon the actuation of the first lockable telescoping spring height adjustment lifting mechanisms, the resilient spring material of the first telescoping spring height adjustment lifting mechanisms may be compressed; and wherein upon actuation, the resilient spring material of the first telescoping spring height adjustment lifting mechanisms, if compressed, will resiliently expand unless a sufficient compressive force is applied to the telescoping spring height adjustment lifting mechanisms;

wherein the first telescoping spring height adjustment lifting mechanisms of the first and second height adjustable columns are sealed against the introduction or loss of material during regular use within the pedestal, which includes periods of height adjustment when the first telescoping spring height adjustment lifting mechanisms are actuated; and wherein the spring material of the each telescoping spring height adjustment lifting mechanism is independent of the spring material of any other telescoping spring height adjustment lifting mechanisms in the height adjustable pedestal; and wherein the actuation and resilient expansion of compressed spring material of the first telescoping spring height adjustment lifting mechanisms results in an upward force applied to the furniture component support causing the rising of the furniture component support; and wherein the first telescoping spring height adjustment lifting mechanisms of the first and second height adjustable columns contributes significantly to the lifting forces applied to the furniture component support; and wherein the first base section and the second base section do not move vertically relative to the floor during height adjustments; and, wherein the first portion of the first height adjustable column does not move relative to the first base section; and wherein the first portion of the second height adjustable column does not move relative to the second base section.

* * * * *